United States Patent [19]

Butler

[11] 3,932,063

[45] Jan. 13, 1976

[54] LIQUID RING PUMPS

[75] Inventor: Denis Victor Butler, Fareham, England

[73] Assignee: Plessey Handel und Investments A.G., Zug, Switzerland

[22] Filed: May 8, 1974

[21] Appl. No.: 468,166

[30] Foreign Application Priority Data

May 11, 1973 United Kingdom ..... 22511/73

[52] U.S. Cl. ..... 417/68; 55/406; 55/408

[51] Int. Cl.[2] ..... F04C 19/00; B01D 45/00

[58] Field of Search ..... 417/68, 69; 55/406, 408

[56] References Cited

UNITED STATES PATENTS

| | | | |
|---|---|---|---|
| 1,904,321 | 4/1933 | Nash | 417/68 |

FOREIGN PATENTS OR APPLICATIONS

| | | | |
|---|---|---|---|
| 888,365 | 8/1953 | Germany | 417/68 |
| 462,208 | 3/1937 | United Kingdom | 417/68 |
| 703,534 | 2/1954 | United Kingdom | 417/68 |
| 1,317,568 | 5/1973 | United Kingdom | 417/68 |
| 1,558,105 | 1/1969 | France | 417/68 |
| 7,004,172 | 9/1970 | Netherlands | 417/68 |

*Primary Examiner*—William L. Freeh
*Assistant Examiner*—Richard E. Gluck
*Attorney, Agent, or Firm*—Fleit & Jacobson

[57] ABSTRACT

A liquid ring pump comprising a housing, a substantially oval chamber within said housing, and a hub supporting a plurality of radially disposed vanes adapted to rotate within said chamber, said pump being such that the interstices between said individual vanes are partially blocked by a blocking mass which rotates with said vanes and which raises the stall pressure ratio of said pump to increase its pumping efficiency. The blocking mass is additional to the hub and in the case where the liquid ring pump also includes a gas/liquid mixture inlet port and a gas discharge port arranged on opposite sides of said pump, then the blocking mass forms a weir which gives the additional advantage that it acts to prevent the direct axial migration of liquid from said inlet port to said gas discharge port, thus enabling said pump to easily separate said gas liquid mixture into separate gas and liquid phases.

3 Claims, 4 Drawing Figures

LIQUID RING PUMPS

This invention relates to liquid ring pumps and to systems incorporating such pumps.

Liquid ring pumps are known in which a pumping action is effected by means of a plurality of radial vanes which rotate in a liquid in a substantially oval chamber in a housing. The vanes rotate on a central rotor and as they rotate the liquid is thrown radially outwardly from the rotor towards the vane tips and a liquid ring is formed which sweeps around the chamber wall. Because the chamber is oval in shape, the vane tips vary in distance from the chamber wall and the liquid ring moves inwardly and outwardly as the vanes rotate in a manner well known to those skilled in the art. The liquid never moves so far inwardly from the chamber wall that it touches the central rotor and thus an inner portion of the chamber volume around the central rotor is never swept by the liquid. If such pumps are used to pump and separate gas/liquid mixtures, it often happens that the pumps reach a stage when they stop pumping. This stage is known as stalling and it occurs when the ratio of delivery absolute pressure to inlet absolute pressure reaches the rotio of total volume of the chamber to unswept volume of the chamber.

It is an aim of the present invention to provide a liquid ring pump which has a better stall pressure ratio than many known liquid ring pumps and therefore has an increased efficiency when pumping gas or gas and liquid mixtures.

Accordingly, this invention provides a liquid ring pump comprising a plurality of radially disposed vanes adapted to rotate within a substantially oval chamber in a housing, the interstices between the vanes being partially blocked by a blocking mass thereby to raise the stall pressure ratio of the pump to increase its pumping efficiency.

Preferably, the liquid ring pump has a gas/liquid mixture inlet port and a gas discharge port arranged on opposite sides of the pump. In this case, the blocking mass will form a weir and will prevent the direct axial migration of liquid from the inlet port to the gas discharge port and will thereby enhance the performance of the pump in the separation mode.

The pump housing may be constituted by a pair of end plates separated by the chamber wall. The various inlet and outlet ports may then be appropriately provided in the end plates.

The invention also extends to systems incorporating the pump of the invention and an example of such a system is a high-speed-high altitude lubrication and scavenge system of the type described and illustrated in our British Pat. No. 1317568.

An embodiment of the invention will now be described by way of example and with reference to the accompanying drawings in which.

Figure 1:
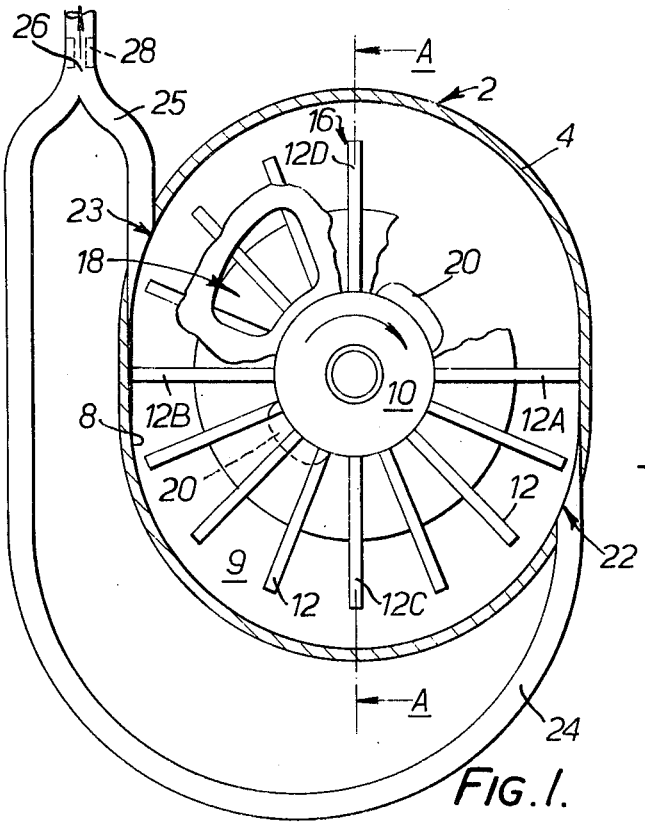
FIG. 1 is a plan view of a liquid ring pump in accordance with the present invention.

Referring to the drawings, there is shown a liquid ring pump 2 comprising a housing 4 of generally oval form having end plates 6. The end plates 6 are spaced apart by a peripheral chamber wall 8 enclosing a chamber 9. The end plates 6 support the axial ends of a cylindrical rotor 10. The rotor 10 has a plurality of vanes 12 radially extending therefrom. Each vane 12 has its tip lying on the same outer radius.

The position of the vanes in the chamber 9 is best seen in FIG. 1. As shown in FIG. 1, the vanes 12A and 12B very nearly touch the inner surface of the wall 8. The remaining vanes 12 get further and further away from the inner surface of the wall 8 until the maximum distance of the vanes from the cylindrical wall 8 is achieved by the vanes 12C and 12D. It can be seen that when the vanes 12 are rotating in a clockwise direction, the spacing of the tips of the vanes from the wall 8 increases from vane 12A to vane 12C, decreases from vane 12C to 12B, increases from vane 12B to vane 12D, and decreases from vane 12D to vane 12A.

Figure 3:
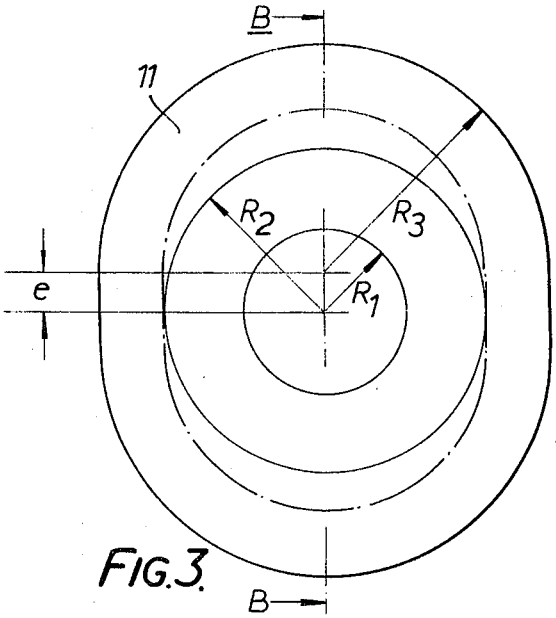
FIG. 3 shows somewhat schematically the chamber of the pump in FIG. 1.
Figure 4:
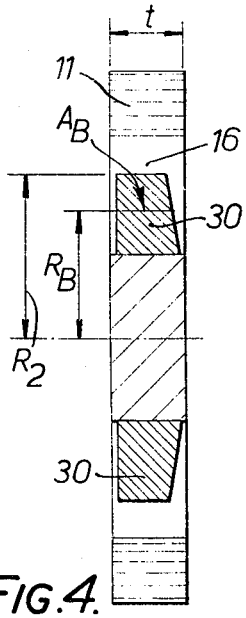
FIG. 4 is a cross-section on the line B—B shown in FIG. 3.

It will be apparent that as the vanes 12 are rotating within the chamber 9, liquid in the chamber will be thrown outwardly and will form the liquid ring 11 shown in FIGS. 3 and 4. Some liquid will always be positioned between the vanes 12 so that there will always be a sealed portion formed by an two vanes 12, the rotor 10 and the liquid ring 11. Obviously the nearer the vanes are to the wall 8, then the more liquid will be forced down between the vanes towards the rotor 10. The various sealed portions between the vanes 12 constitute the unswept volume of the chamber 9.

One end plate 6 is provided with a gas/liquid entry port 18. The shape of the port 18 is shown most clearly in FIG. 1 and it will be seen that the port increases in area in the clockwise direction of rotation of the rotor 10 and also that the port 18 is located between the vanes 12B and 12D. Two gas outlets 20 are provided in the other end plate 6 and the shape of each gas outlet 20 is again shown most clearly in FIG. 1. The position of each gas outlet 20 is near the rotor 10, i.e. furthest away from the liquid which is thrown outwardly.

Liquid outlets 22, 23 are provided substantially at vanes 12A and 12B where the change-over occurs from minimum casing radius to increasing casing radius. The liquid outlets 22, 23, respectively communicate with conduits 24, 25, and liquid, e.g. oil, taken from the liquid ring 11 via the outlets 22, 23, passes along the conduits 24, 25. These conduits 24, 25, join together to form a single conduit 26. The conduit 26 is provided a restrictor 28 which acts to limit the amount of liquid which can be drawn off from the liquid ring 11 through the outlets 22, 23.

Figure 2:
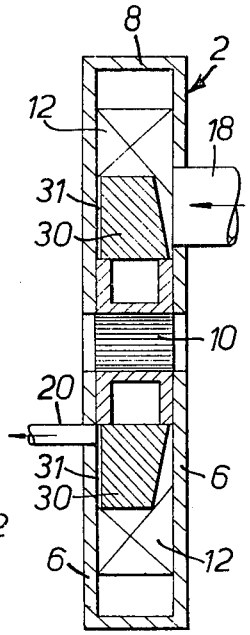
FIG. 2 is a cross-section on the line A—A shown in FIG. 1.

Situated between each pair of vanes 12 as shown most clearly in FIG. 2 is a blocking mass 30 which may be of any suitable material. The material chosen should obviously not be attacked by the liquid in the pump. Preferably, the blocking mass is made of brass or mild steel.

In operation, the pump imparts an angular velocity to liquid, e.g. oil, within the pump casing 4. This angular velocity imparted to the liquid causes the liquid to form the ring 11 over the inner surface of the peripheral wall 8 of the casing. This liquid ring 11 is moving inwardly and outwardly with respect to the rotor 10 as the distance of the vanes 12 varies from the wall 8. As the liquid moves away from the rotor 10 towards the position 16, there is an increasing kinetic energy in the liquid which it utilised to suck in a gas/liquid mixture through the port 18. As any one vane compartment moves from the position of vane 12D or 12C towards vane 12A or 12B, the liquid gets forced back down the vane interstices towards the rotor 10 and displaces air out of the gas outlets 20. Liquid is taken off as mentioned above from the liquid ring 11 via the outlets 22, 23.

The illustrated pump can accept gas/liquid mixtures, foam, mists, etc. It can separate them and return a liquid to a reservoir and the gas to atmosphere or to a pressurised vessel as required. Foams and mists induced near the centre of the pump, where the centrifugal accelerations are low, can be carried over to the exhaust sector of the pump by a conventional open impeller and pass out of the pump unseparated.

As indicated above, the interstices between the vanes 12 are blocked by the blocking masses 30. Each blocking mass 30 preferably blocks its interstice from the central hub to the minimum radius of the liquid ring, leaving sufficient axial space on each side to allow the passage of gas and liquid to and from the ports 18 and 20.

The blocking of the unswept volume of the pump increases the total volume to unswept volume ratio and thereby the stall pressure ratio of the pump. Also, by siting the inlet port 18 on one side of the material 30 and the outlet ports 20 on the other side, the blocking mass 30 forms a weir over which all fluid entering the pump must pass before leaving. As shown most clearly in FIG. 2, the gas has to pass over each mass 30 and along the narrow passage 31 formed between the mass 30 and the end plate 6. The mass 30 ensures that all fluid entering the pump passes through an area of high centrifugal acceleration and any liquid entrained in the gas must go against the full centrifugal head to leave the pump via the gas outlet ports 20.

There will now be given a typical example using FIGS. 3 and 4, and giving actual pump measurements.

In the following calculation;

$R_1$ = radius of solid hub $R_2$ = outer radius of blocking mass 30

$R_3$ = casing radius $R_B$ = radius of blocking cross-section centroid $e$ = eccentricity of casing radii $A_B$ = cross sectional area of blocking mass 30

$t$ = width of pump a. Swept volume of pump $= 2R_2 2et \; 2et = 4R_2\, et$ $= 4 \times 1.06 \times 0.25 \times 0.5 = 0.53$ cu ins b. Total Volume of unblocked pump $= [\pi(R_2^2 - R_1^2) + 4R_2 e]\, t$ $[\pi(1.06^2 - 0.53^2) + 1.06]\, 0.5$ $(2.647 + 1.06)0.5 = 3.707 \times 0.5 = 1.853$ cu ins c. Total volume of blocked pump $= (b) - 2\, R_B A_B$ $= 1.853 - 2 \times 0.8 \times \pi$ $= 1.853 - 0.95 = 0.903$ cu ins d. Unswept volume of unblocked pump $= (b) - (a) = 1.853 - 0.53 = 1.323$ cu ins e. Unswept volume of blocked pump $= (c) - (a) = 0.903 - 0.53 = 0.373$ cu ins f. Stall pressure ratio of unblocked pump $$= \frac{(b)}{(d)} = \frac{1.853}{1.323} = \underline{1.4}$$

g. Stall pressure ratio of blocked pump $$= \frac{(c)}{(e)} = \frac{0.903}{0.373} = \underline{2.42}$$

Comparing the performance of (f) to (g)

When exhausting to an atmosphere of 15 psia, the theoretical stall inlet pressure of:

$$(f) \text{ will be } \frac{15}{1.4} = \underline{0.65 \text{ psia}}$$

and $$(g) \text{ will be } \frac{15}{2.42} = \underline{6.2 \text{ psia}}$$

What we claim is:

1. A liquid ring pump for separating a gas/liquid mixture into gas and liquid comprising, in combination, a housing having a pair of end plates and a sidewall defining a substantially oval chamber within said housing, a rotatable hub disposed within said chamber, a plurality of vanes mounted on said hub and projecting radially outward from said hub, a blocking mass having a pair of side faces disposed in the interstices between said vanes for partially blocking said interstices, one of said side faces being disposed in spaced-apart relationship with one of said housing end plates to define a radially extending first axial space forming a radially outward flow path for the gas/liquid mixture, a gas/liquid inlet port in said one housing end plate disposed opposite said blocking mass one side face for introducing a gas/liquid mixture into said chamber in an axial direction against said one side face, the other of said side faces being disposed in spaced-apart relationship with the other of said end plates to define a radially extending second axial space forming a radially inward flow path for the gas separated from said gas/liquid mixture, a gas outlet port in said other housing end plate disposed opposite said blocking mass other side face for discharging gas flowing radially inward in said second axial space, at least one liquid outlet on said housing for receiving separated liquid from said gas/liquid mixture, said liquid passing to said liquid outlet from a liquid ring formed in said chamber during operation of said pump, said blocking mass being effective to raise the stall pressure ratio of said pump thereby increasing its efficiency and to form a weir for preventing the axial migration of liquid from said inlet port to said outlet port thereby increasing the amount of liquid separated from said gas/liquid mixture.

2. A liquid ring pump according to claim 1, in which said liquid outlet includes restrictor means, said restrictor means being effective to restrict the amount of separated liquid passing from said chamber through said liquid outlet.

3. A liquid ring pump according to claim 1, in which said blocking mass extends from said hub of said pump to the minimum radius of said liquid ring.

* * * * *